US009069310B2

(12) United States Patent
Yamamoto

(10) Patent No.: US 9,069,310 B2
(45) Date of Patent: Jun. 30, 2015

(54) IMAGE HEATING APPARATUS

(71) Applicant: CANON KABUSHIKI KAISHA, Tokyo (JP)

(72) Inventor: Naoyuki Yamamoto, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1 day.

(21) Appl. No.: 13/947,474

(22) Filed: Jul. 22, 2013

(65) Prior Publication Data

US 2014/0029992 A1 Jan. 30, 2014

(30) Foreign Application Priority Data

Jul. 30, 2012 (JP) ..... 2012-168933

(51) Int. Cl.
*G03G 15/20* (2006.01)

(52) U.S. Cl.
CPC .... *G03G 15/2064* (2013.01); *G03G 2215/2032* (2013.01); *G03G 2215/2016* (2013.01); *G03G 15/2078* (2013.01); *G03G 15/2053* (2013.01); *G03G 15/2039* (2013.01)

(58) Field of Classification Search
CPC ..... G03G 15/20
USPC ..... 399/328
See application file for complete search history.

(56) References Cited

U.S. PATENT DOCUMENTS 5,819,150 A * 10/1998 Hayasaki et al. ..... 399/330
6,373,232 B1 * 4/2002 Mano et al. ..... 323/282
6,799,002 B2 * 9/2004 Birumachi ..... 399/67
7,196,296 B2 * 3/2007 Yamamoto ..... 219/619
7,205,514 B2 4/2007 Suzuki et al.
7,238,924 B2 7/2007 Kondo et al.
7,268,326 B2 9/2007 Yamamoto et al.
7,268,327 B2 9/2007 Yamamoto et al.
7,565,102 B2 * 7/2009 Suzuki ..... 399/328

(Continued)

FOREIGN PATENT DOCUMENTS

JP 3-145682 6/1991
JP 2000-019870 * 1/2000 ..... G03G 15/20

(Continued)

OTHER PUBLICATIONS

European Search Report dated Feb. 18, 2014, issued in European Application No. 13178149.4-1560.

*Primary Examiner* — Clayton E Laballe
*Assistant Examiner* — Kevin Butler
(74) *Attorney, Agent, or Firm* — Fitzpatrick, Cella, Harper & Scinto

(57) ABSTRACT

An image heating apparatus includes: an exciting coil; a current applying device configured to apply a high-frequency current to the exciting coil; a rotatable heating member configured to heat a toner image on a recording material at a nip, wherein the rotatable heating member includes a first electroconductive layer for generating heat by electromagnetic induction of magnetic flux from the exciting coil; a rotatable pressing member configured to press-contact the rotatable heating member to form the nip, wherein the rotatable pressing member includes a second electroconductive layer electrically insulated from the first electroconductive layer; and a rectifying element configured to be connected between the second electroconductive layer and the ground in a direction in which a surface potential of the rotatable pressing member has an opposite polarity to a normal charge polarity of a toner.

14 Claims, 13 Drawing Sheets

(56) References Cited

U.S. PATENT DOCUMENTS

| | | | | |
|---|---|---|---|---|
| 8,099,008 | B2 | 1/2012 | Nakase et al. | |
| 8,358,949 | B2 * | 1/2013 | Nakase et al. | 399/69 |
| 2003/0068169 | A1 * | 4/2003 | Suzuki | 399/69 |
| 2003/0095818 | A1 * | 5/2003 | Nakayama | 399/328 |
| 2004/0007569 | A1 * | 1/2004 | Ohta | 219/624 |
| 2006/0088327 | A1 * | 4/2006 | Nakase et al. | 399/69 |
| 2006/0245797 | A1 * | 11/2006 | Suzuki | 399/328 |
| 2011/0091230 | A1 | 4/2011 | Yamamoto | |
| 2012/0118877 | A1 * | 5/2012 | Nakase et al. | 219/645 |
| 2012/0328338 | A1 | 12/2012 | Nawa et al. | |
| 2012/0328342 | A1 | 12/2012 | Takematsu et al. | |
| 2013/0094887 | A1 * | 4/2013 | Nawa et al. | 399/330 |
| 2013/0098900 | A1 | 4/2013 | Nakase et al. | |
| 2014/0029992 | A1 * | 1/2014 | Yamamoto, Naoyuki | 399/328 |

FOREIGN PATENT DOCUMENTS

| | | | |
|---|---|---|---|
| JP | 2000-19870 | A | 1/2000 |
| JP | 2002-132077 | A | 5/2002 |
| JP | 2004-54182 | A | 2/2004 |
| JP | 2005-123113 | | 5/2005 |
| JP | 2010-117565 | A | 5/2010 |

* cited by examiner (a)

(b)

(a)

(b)

(a)

(b)

IMAGE HEATING APPARATUS

This application claims priority from Japanese Patent Application No. 168933/2012 filed Jul. 30, 2012, which is hereby incorporated by reference.

FIELD OF THE INVENTION AND RELATED ART

The present invention relates to an image heating apparatus capable of being used as an fixing device (apparatus) or the like in an image forming apparatus, such as a copying machine, a printer or a facsimile machine, using an electrophotographic type or an electrostatic recording type.

The image forming apparatus using the electrophotographic type or the like includes the fixing device as the image heating apparatus for fixing an unfixed toner image, formed on a recording material such as recording paper, on the recording material. For example, such a fixing device includes a fixing roller (rotatable heating member) for thermally melting the unfixed toner image on the recording material and a pressing roller (rotatable pressing member) for nipping the recording material in press-contact with the fixing roller.

Incidentally, in such a fixing device, there is a relationship such that the unfixed toner image directly contacts a surface of the fixing roller, and therefore there is a problem such that a so-called offset phenomenon that a part of the unfixed toner image is electrostatically transferred onto the fixing roller surface is generated.

This offset due to the electrostatic factor (also referred to as "electrostatic offset") is such a phenomenon that an electrically charged toner on the recording material is electrostatically transferred onto the fixing roller surface and results from a relationship between an electrostatic depositing force, between the toner and the recording material, and an electrostatic depositing force between the toner and the fixing roller.

The unfixed toner image on the recording material is electrostatically hold on the recording material strongly by electric charges of the toner itself and electric charges (opposite in polarity to those of the toner) injected into the back surface of the recording material during the transfer.

However, in the case where a surface of the pressing roller in a side where it does not contact the unfixed toner image is electrically charged to an identical polarity to the charge polarity of the toner, the pressing roller surface is opposite in polarity to the electric charges injected into the back surface of the recording material, and therefore when the recording material passes through a fixing nip, the electric charges on the back surface of the recording material are neutralized by the electric charges on the surface of the pressing roller. As a result, with respect to a part of the unfixed toner image, the electrostatic depositing force with the recording material is lowered, and therefore the electrostatic offset can occur.

Accordingly, the electrostatic offset is suppressed by properly maintaining a surface potential of the pressing roller.

In order to suppress such electrostatic offset, as a method in which a high-voltage source is not needed, the following method is proposed. In Japanese Laid-Open Patent Application (JP-A) Hei 3-145682, a method in which a portion is connected each between a core metal of the fixing roller and the ground and between a core metal of the pressing roller and the ground is proposed. Further, in JP-A 2005-123113, a method in which an electromotive force generating circuit including a capacitor, a diode and a resistor is connected with the fixing roller is proposed.

However, in the method proposed in JP-A Hei 3-145682, the surface potential of each roller is determined depending on a degree of triboelectric charge by friction between the fixing roller and the pressing roller or a degree of triboelectric charge by friction between the recording material and each roller (fixing roller or pressing roller). However, these factors which determine the surface potential of each roller vary depending on the recording material used, a recording material passing fixing roller (productivity), a surface property (material, durability deterioration, etc.) of each roller, and operation environment, and thus is not constant. For that reason, a charge polarity of the surface potential of each roller can only be determined, so that it is difficult to control the surface potential. Further, when many recording materials are continuously subjected to fixing, the electric charges by the triboelectric charge are continuously accumulated, and therefore there are fears of leakage and scattered image.

On the other hand, in the method proposed in JP-A 2005-123113, the surface potential of the fixing roller is determined by a voltage induced in the fixing roller by an exciting coil and the electromotive force generating circuit. For that reason, it is possible to control the surface charge polarity and surface potential of the fixing roller. However, the electromotive force generating circuit having a relatively complicated constitution is needed. Further, suppression of the electrostatic offset generated by the electric charge of the pressing roller surface to the identical polarity to the toner charge polarity is not taken into consideration.

SUMMARY OF THE INVENTION

A principal object of the present invention is to provide an image heating apparatus capable of suppressing electrostatic offset.

According to an aspect of the present invention, there is provided an image heating apparatus comprising: an exciting coil; a current applying device configured to apply a high-frequency current to the exciting coil; a rotatable heating member configured to heat a toner image on a recording material at a nip, wherein the rotatable heating member includes a first electroconductive layer for generating heat by electromagnetic induction of magnetic flux from the exciting coil; a rotatable pressing member configured to press-contact the rotatable heating member to form the nip, wherein the rotatable pressing member includes a second electroconductive layer electrically insulated from the first electroconductive layer; and a rectifying element configured to be connected between the second electroconductive layer and the ground in a direction in which a surface potential of the rotatable pressing member has an opposite polarity to a normal charge polarity of a toner.

According to another aspect of the present invention, there is provided an image heating apparatus comprising: an exciting coil; a current applying device configured to apply a high-frequency current of 10 kHz to 100 kHz in frequency to the exciting coil; a heating roller configured to heat a toner image on a recording material at a nip, wherein the heating roller includes a core metal for generating heat by electromagnetic induction of magnetic flux from the exciting coil and includes an insulating surface layer provided on the core metal and having a volume resistivity of $10^{16}$ Ω·cm or more; a pressing roller configured to press-contact the heating roller to form the nip, wherein the pressing roller includes an electroconductive surface layer electrically insulated from the core metal and having a volume resistivity of $10^{3}$ to $10^{13}$ Ω·cm; a diode configured to be connected between the core metal and the ground in a direction in which a surface potential of the heating roller has an identical polarity to a normal charge polarity of a toner; and another diode configured to be connected between the electroconductive surface layer and the ground in a direction in which a surface potential of the pressing roller has an opposite polarity to the normal charge polarity of the toner.

These and other objects, features and advantages of the present invention will become more apparent upon a consideration of the following description of the preferred embodiments of the present invention taken in conjunction with the accompanying drawings.

Figure 7:
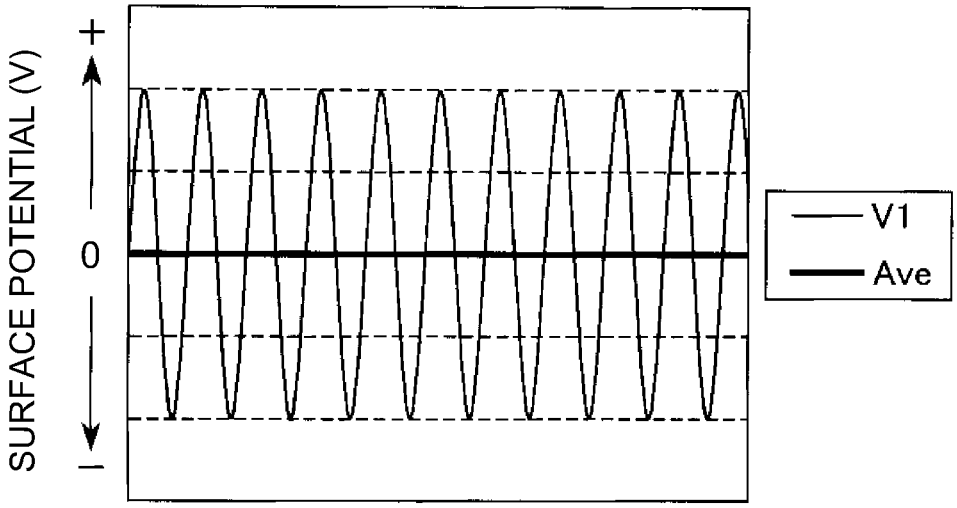
Figure 7:
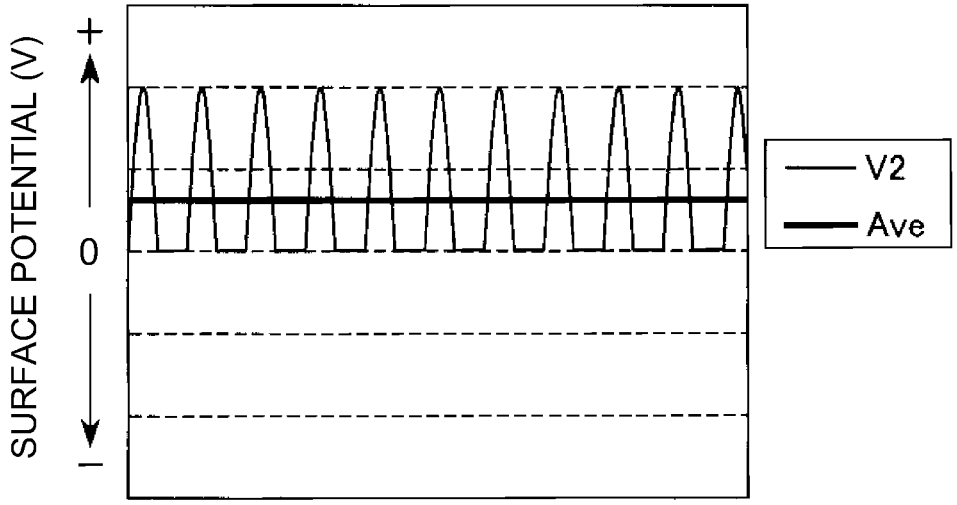

Parts (a) and (b) of FIG. 7 are graphs showing surface potential waveforms of the fixing roller and a pressing roller, respectively, in Embodiment 1.

Figure 8:
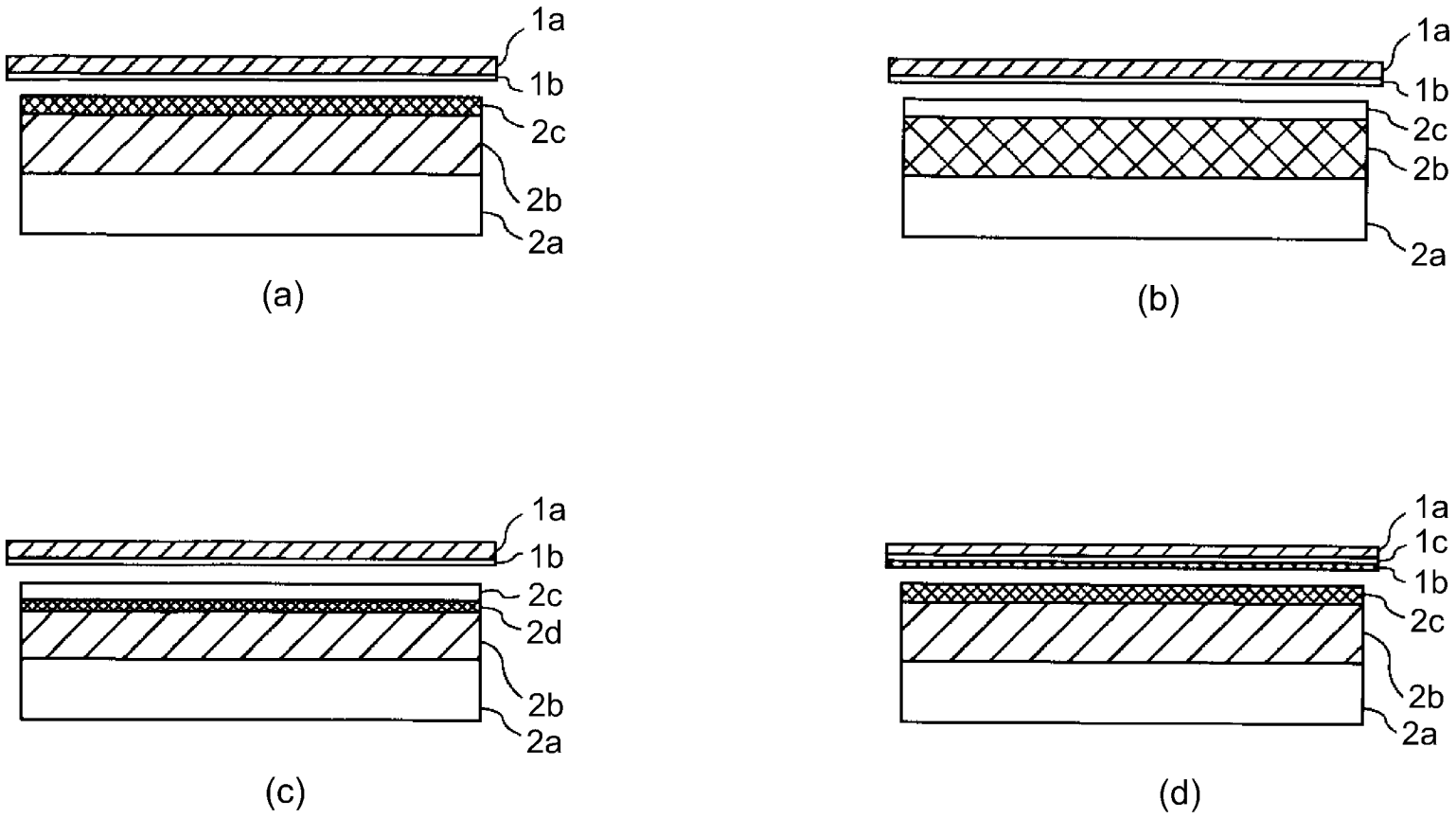

Parts (a) to (d) of FIG. 8 are schematic enlarged views each showing the fixing nip of the fixing device in Embodiment 1.

Figure 9:
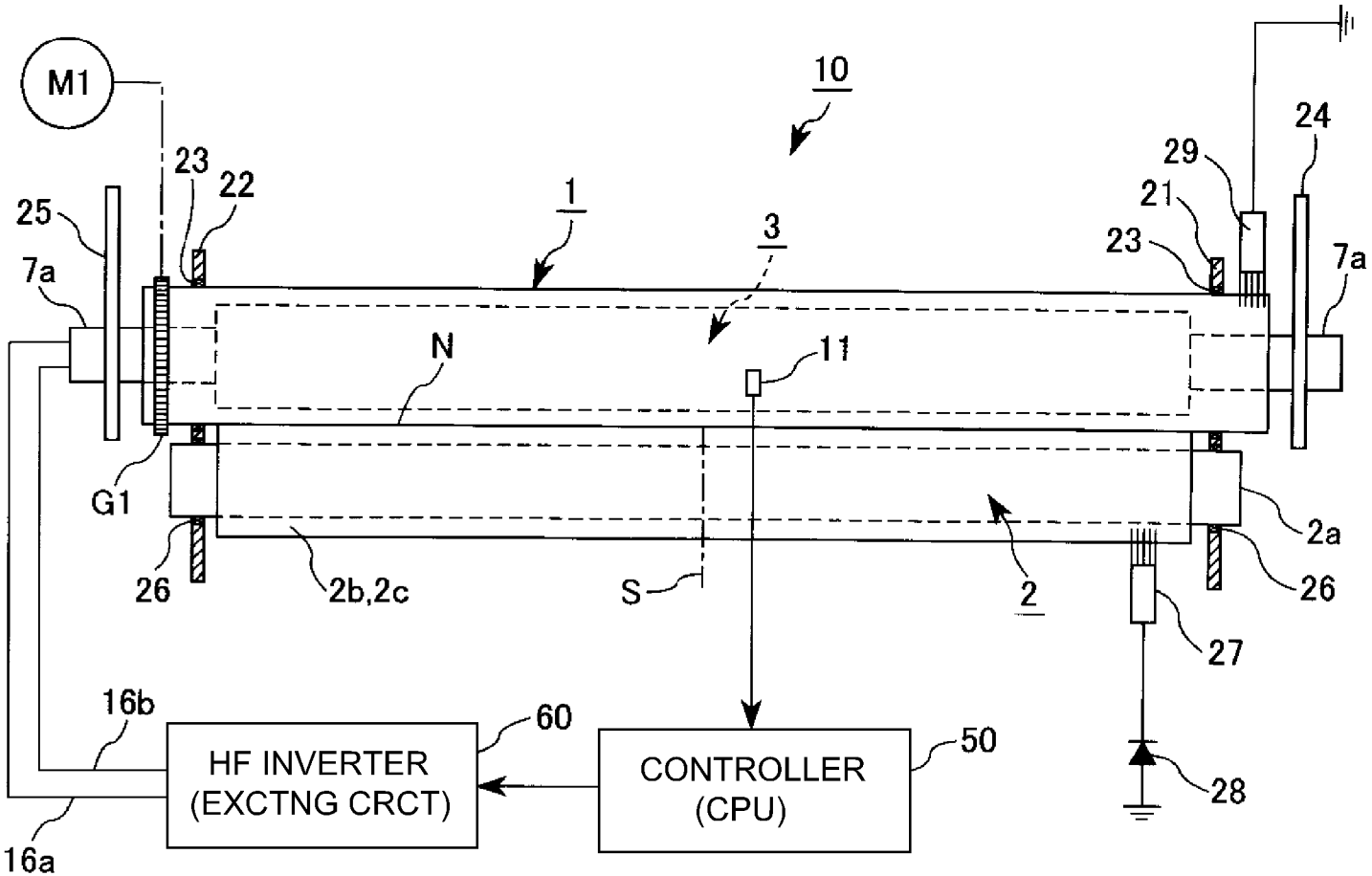

FIG. 9 is a schematic front view of a fixing device in Embodiment 2.

Figure 10:
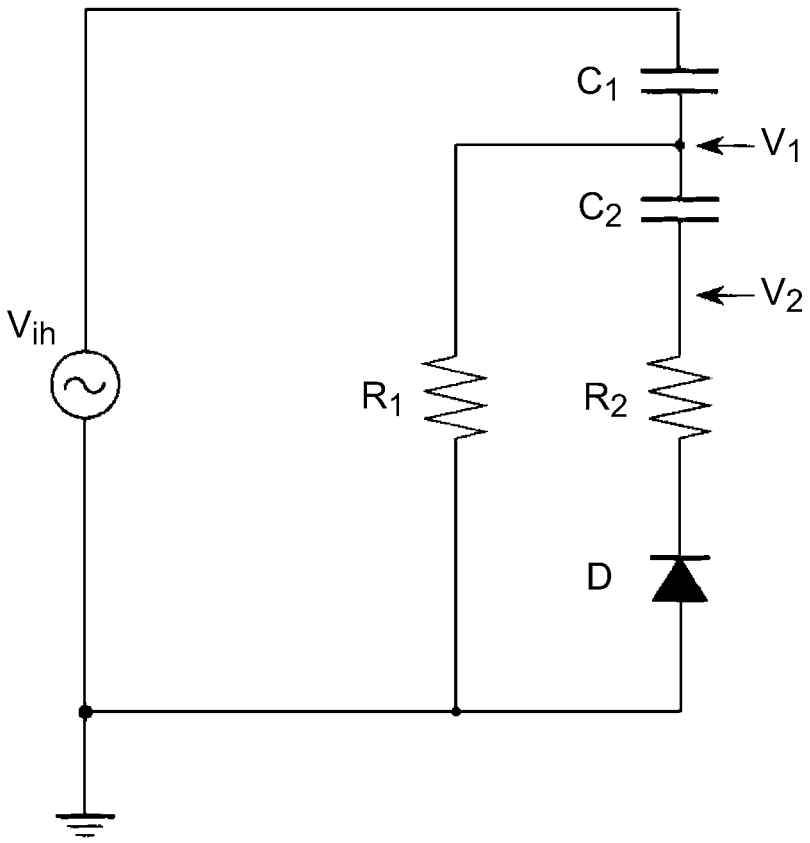

FIG. 10 is an equivalent circuit diagram of the fixing device in Embodiment 2.

Figure 11:
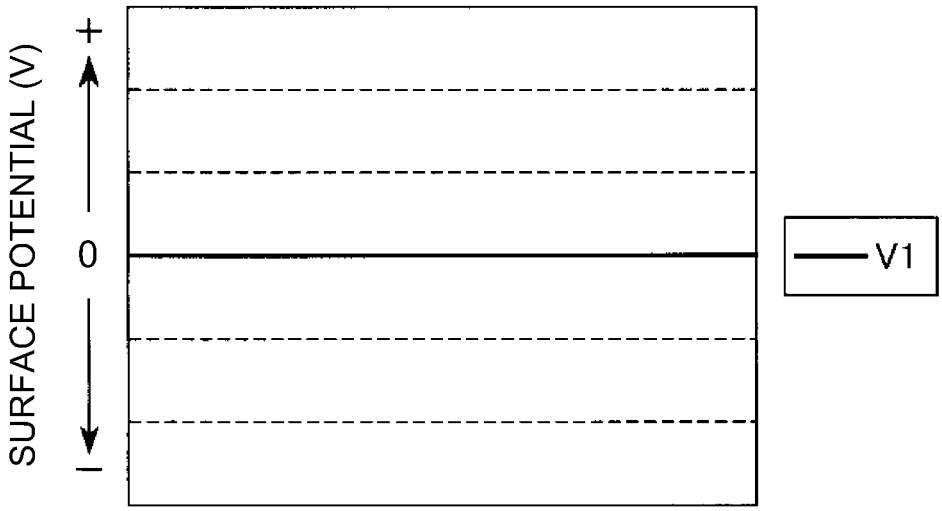
Figure 11:
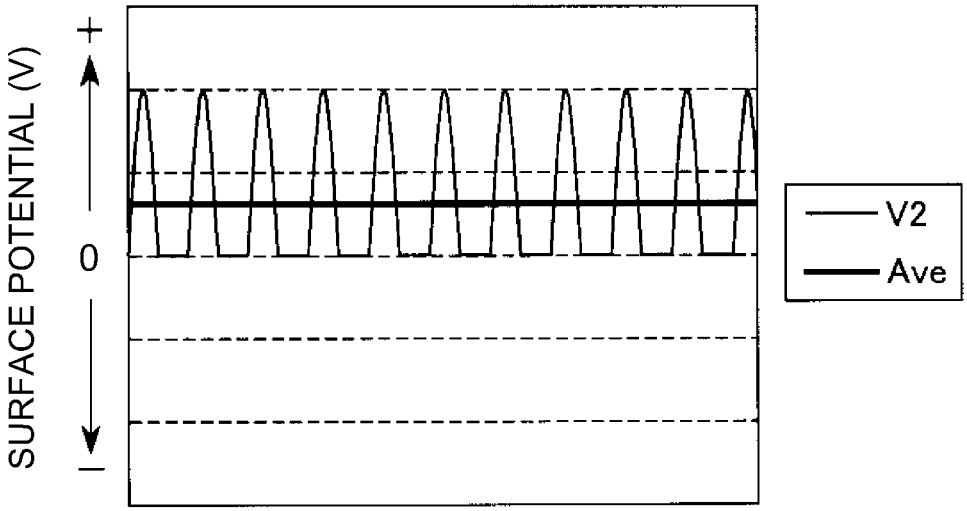

Parts (a) and (b) of FIG. 11 are graphs showing surface potential waveforms of a fixing roller and a pressing roller, respectively, in Embodiment 2.

Figure 12:
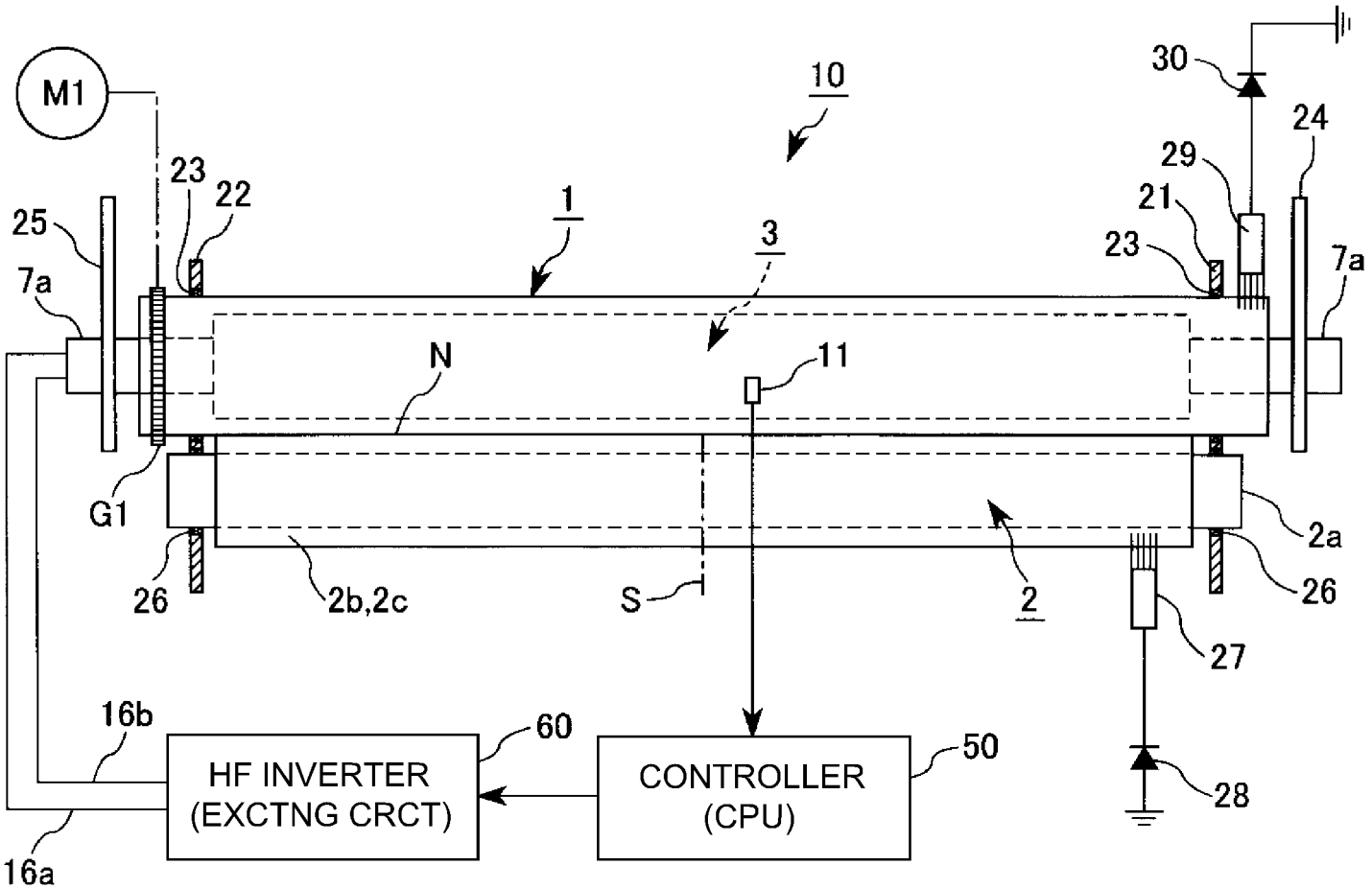

FIG. 12 is a schematic front view of a fixing device in Embodiment 3.

Figure 13:
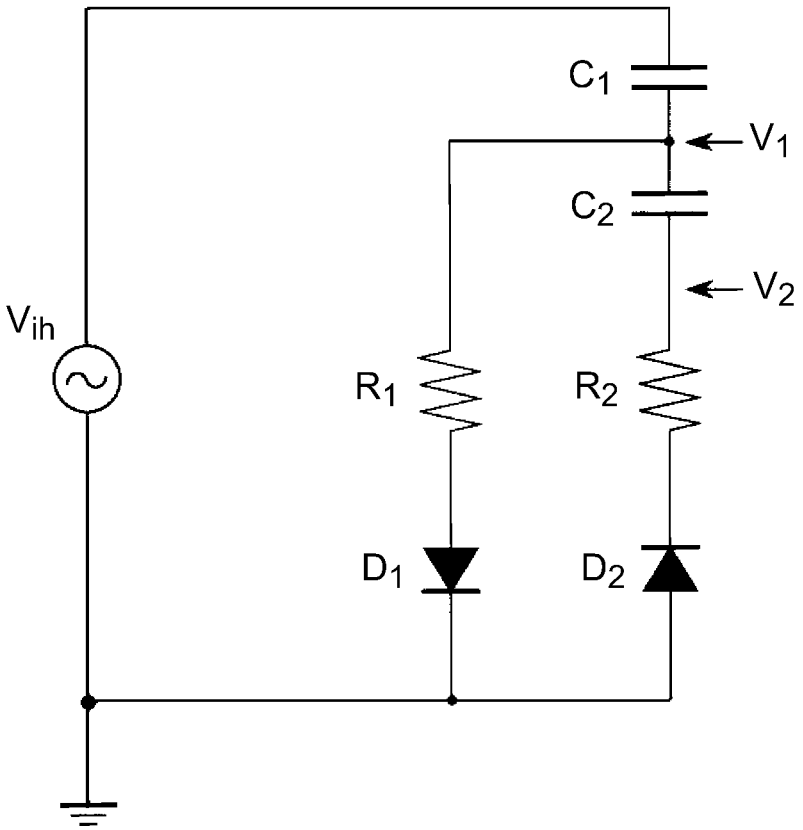

FIG. 13 is an equivalent circuit diagram of the fixing device in Embodiment 3.

Figure 14:
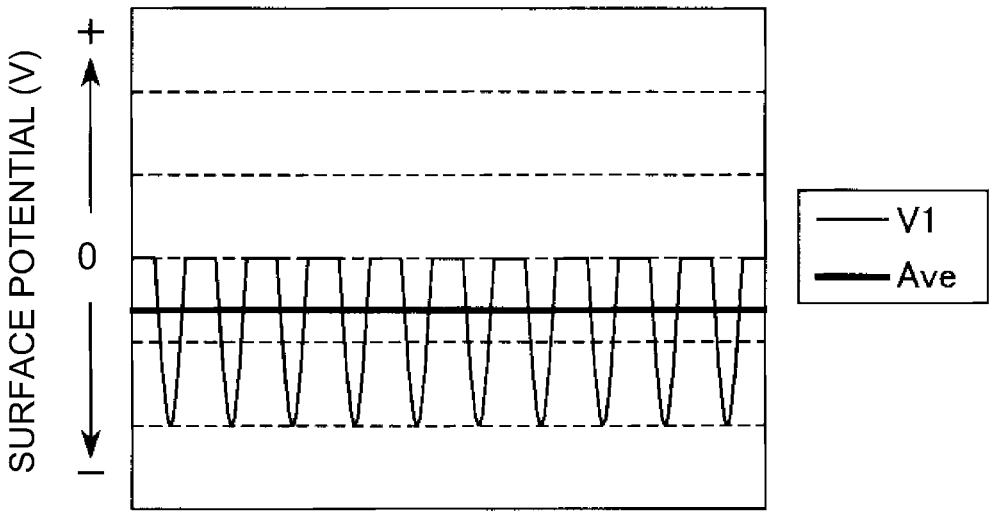
Figure 14:
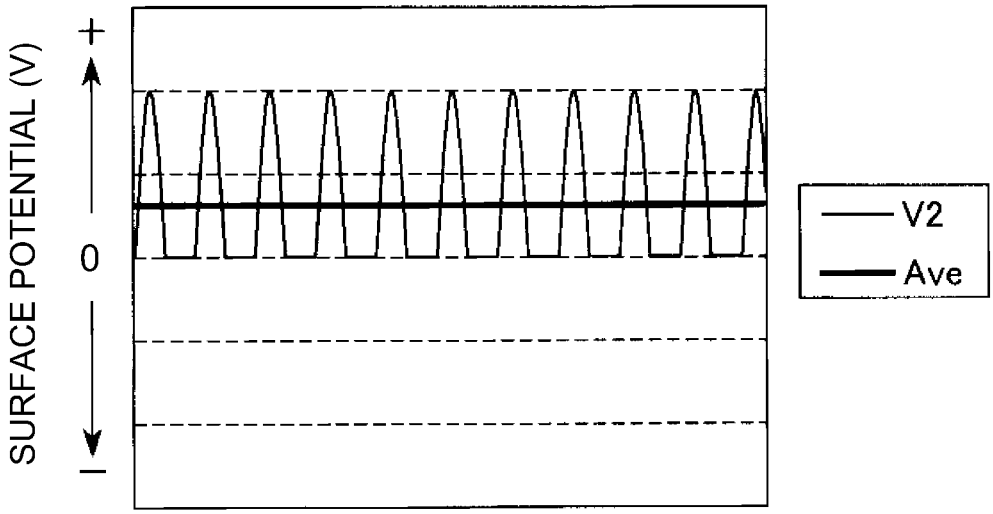

Parts (a) and (b) of FIG. 14 are graphs showing surface potential waveforms of a fixing roller and a pressing roller, respectively, in Embodiment 3.

DESCRIPTION OF THE PREFERRED EMBODIMENTS

The image heating apparatus according to the present invention will be specifically described below with reference to the drawings.

Embodiment 1

1. General Structure and Operation

Figure 1:
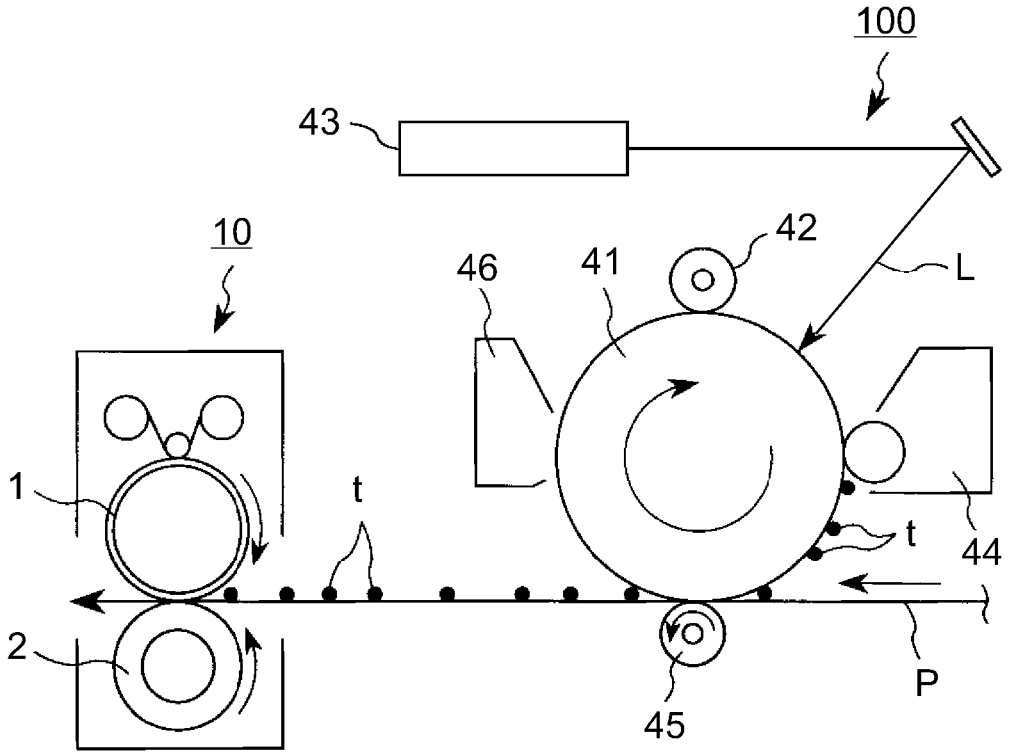
FIG. 1 is a schematic sectional view of an example of an image forming apparatus in Embodiment 1.

FIG. 1 is a schematic sectional view of an example of an image forming apparatus including, as a fixing device (apparatus), an image heating apparatus of an electromagnetic induction heating type according to Embodiment 1 of the present invention.

An image forming apparatus 100 in this embodiment is a digital image forming apparatus (copying machine, printer, facsimile machine, multi-function machine of these machines, or the like), of a laser scanning exposure type, using a transfer-type electrophotographic process.

The image forming apparatus 100 includes a photosensitive drum 41 which is, a rotatable drum-type electrophotographic photosensitive member as an image bearing member. The photosensitive drum 41 is, in its rotation process, electrically charged by a charging roller (primary charger) 42 which is a roller-type charging member as a charging means. In this embodiment, the photosensitive drum 41 is electrically charged substantially uniformly to a predetermined dark portion potential Vd of a negative polarity.

The surface of the photosensitive drum 41 charged substantially uniformly is subjected to scanning exposure with a laser beam L by a laser beam scanner 43 as an exposure means. The laser beam scanner 43 outputs the laser beam L modulated correspondingly to a digital image signal inputted from a host device (not shown) such as an image reader, a word processor or a computer. By subjecting the photosensitive drum surface to the scanning exposure with the laser beam L, an absolute value of the potential of the photosensitive drum 41 at an exposed portion is decreased to a light portion potential Vl. As a result, an electrostatic latent image (electrostatic image) corresponding to the image signal is formed on the surface of the photosensitive drum 41.

The electrostatic latent image formed on the surface of the photosensitive drum 41 is developed (visualized) as a toner image by a developing device 44 as a developing means. In this embodiment, the toner image is formed by depositing a negatively charged toner on the surface of the photosensitive drum 41 at the exposed portion (light portion potential Vl portion) by the developing device 44. That is, in this embodiment, an intended charge polarity (normal charge polarity) of the toner with which the electrostatic latent image is developed is the negative polarity.

On the other hand, a recording material (sheet) P, such as recording paper, fed from a sheet feeding tray (not shown) is conveyed, at proper timing synchronized with rotation of the photosensitive drum 41, to a press-contact portion (transfer portion) between the photosensitive drum 41 and a transfer roller 45 which is a roller-type member as a transfer means. Then, toner images t on the photosensitive drum 41 are successively transferred electrostatically onto the surface of the recording material P. At this time, to the transfer roller 45, a transfer bias which is a DC voltage of an opposite polarity to the normal charge polarity (the negative polarity in this embodiment) of the toner is applied.

The recording material P on which the toner images t are transferred is separated from the photosensitive drum 41 and is then introduced into a fixing device 10 described below. Then, the recording material P is subjected to fixing of the toner images t under application of pressure and heat while being conveyed by the fixing device 10. Thereafter, the recording material P on which the image is fixed is discharged to an outside of the image forming apparatus.

Further, the photosensitive drum 41 after the recording material P is separated therefrom is subjected to removal of a transfer residual matter such as the toner remaining on its surface by a cleaning device 46 as a cleaning means. Thereafter, the photosensitive drum 41 is repetitively subjected to image formation.

2. General Structure and Operation of Fixing Device

Next, a structure of the fixing device 10 as the image heating apparatus will be described.

Figure 2:
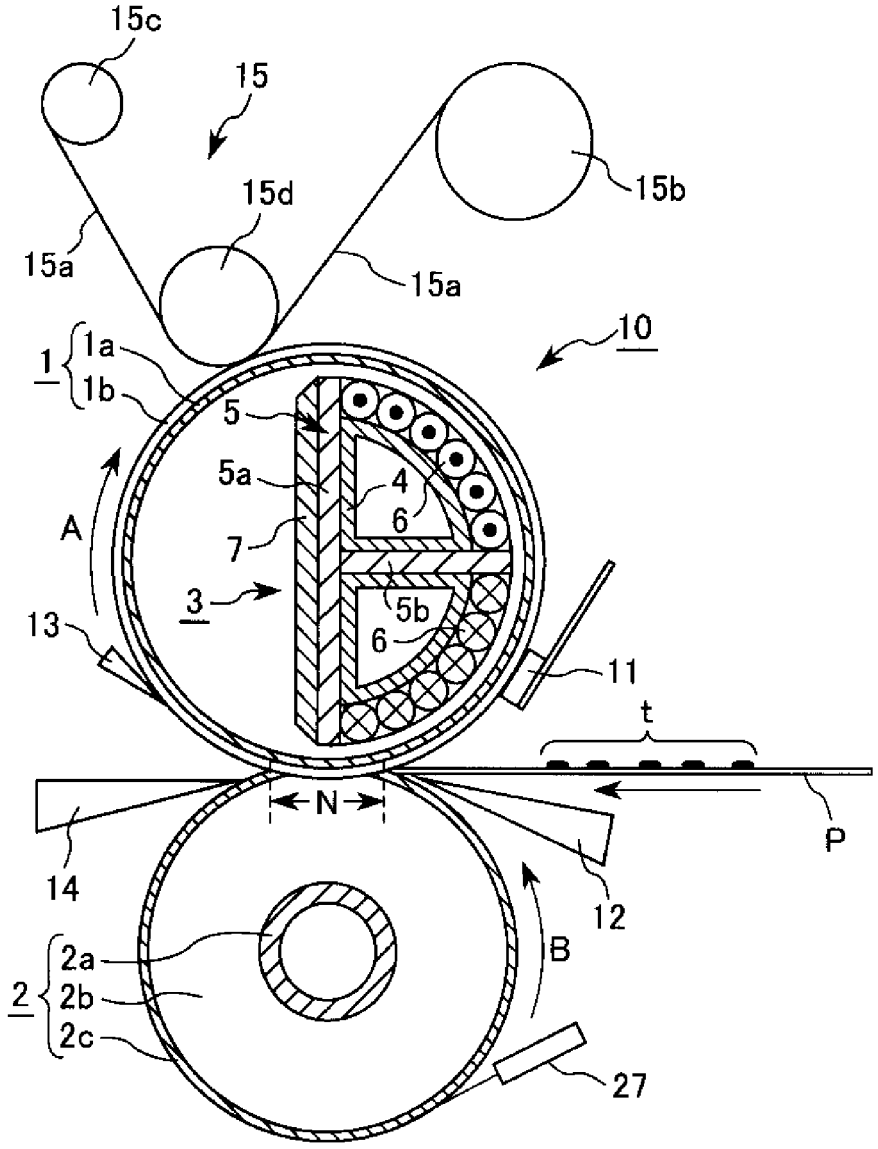
FIG. 2 is a schematic sectional view of a fixing device (image heating apparatus of an electromagnetic induction heating type) in Embodiment 1.
Figure 3:
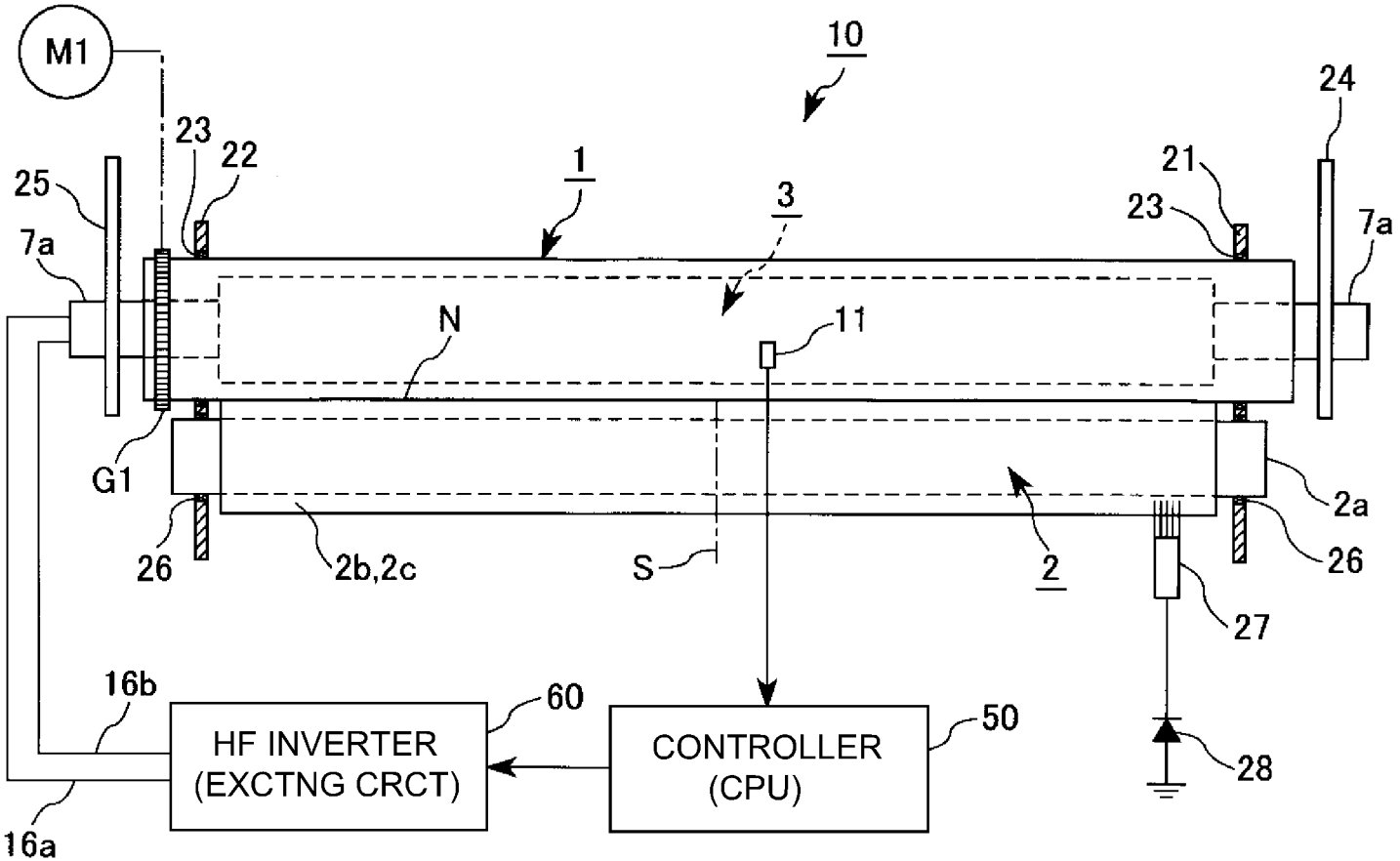
FIG. 3 is a schematic front view of the fixing device in Embodiment 1.
Figure 4:
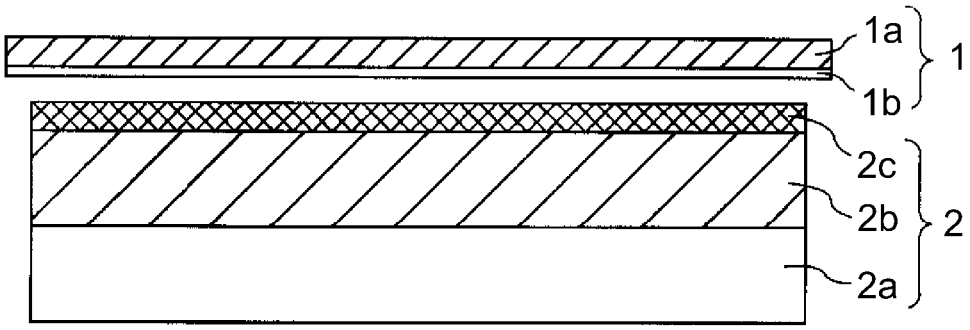
FIG. 4 is a schematic enlarged view of a fixing nip of the fixing device in Embodiment 1.

FIG. 2 is a schematic sectional view of a principal part of the fixing device 10 in this embodiment. FIG. 3 is a schematic plan view of the principal part of the fixing device 10 in this embodiment. FIG. 4 is a schematic enlarged view of a fixing nip N in the fixing device 10 in this embodiment.

Incidentally, with respect to the image forming apparatus 100 and the fixing device 10, a front side and a rear side are an end portion side and another end portion side, respectively, with respect to a direction substantially perpendicular to a conveyance direction of the recording material P, and in FIGS. 1 and 2, refer to the front side and the rear side, respectively, on their drawing sheets.

The fixing device 10 is an example of a heating apparatus of the electromagnetic induction heating type. The fixing device 10 includes a fixing roller 1 as a rotatable heating member (first rotatable member) and a pressing roller 2 as a rotatable pressing member (second rotatable member). The fixing roller 1 and the pressing roller 2 are a pair of rollers which are press-contacted by a predetermined urging force, and at the press-contact portion, the fixing nip N is formed in a predetermined width with respect to the conveyance direction of the recording material P. The fixing roller 1 and the pressing roller 2 are provided and arranged in a vertical (up-down) direction in this embodiment so that rotational axis directions of these rollers 1 and 2 are substantially in parallel with each other.

The fixing roller 1 includes a core metal 1*a* as an electroconductive heat generating layer (electroconductive layer) for generating heat by electromagnetic induction and includes a surface layer 1*b* as an insulating surface layer provided on a peripheral surface of the core metal 1*a*. The core metal 1*a* is formed of ferromagnetic metal such as iron, nickel or alloy of these. The surface layer 1*b* is formed of fluorine-containing resin such as PFA or PTGE in order to enhance a toner parting property at the surface of the fixing roller 1. In this embodiment, the fixing roller 1 is 40 mm in outer diameter, 0.5 mm in thickness and 340 mm in length with respect to the rotational axis direction. Further, in this embodiment, the surface layer 1*b* is 30 μm in thickness. Incidentally, in order to obtain a high-quality fixed image such as a color image, between the core metal 1*a* and the surface layer 1*b*, a heat-resistant elastic layer is formed with a heat-resistant elastic member such as a silicone rubber. The fixing roller 1 is, at its end portions with respect to its rotational axis direction, rotatably supported by side plates (fixing unit frames) 21 and 22 via bearings 23 and 23 in the front and rear sides of the fixing device 10.

Into a hollow portion inside the fixing roller 1, a coil assembly 3 as a magnetic field generating means for generating a high-frequency magnetic field (AC magnetic field) for inducing an induced current (eddy current) in the fixing roller 1 to heat the fixing roller 1 by Joule heating is inserted and disposed.

The pressing roller 2 includes a core metal 2*a*, a heat-resistant elastic layer 2*b* as an elastic layer provided on a peripheral surface of the core metal 2*a*, and a surface layer 2*c* as an electroconductive surface layer formed of an electroconductive material on a peripheral surface of the heat-resistant elastic layer 2*b*. The core metal 2*a* is formed with an electroconductive member such as iron. The heat-resistant elastic layer 2*b* is formed with a heat-resistant elastic member such as a silicone rubber. The electroconductive surface layer 2*c* is formed of electroconductive fluorine-containing resin or the like. In this embodiment, the pressing roller 2 is 38 mm in outer diameter and 330 mm in length with respect to the rotational axis direction. Further, in this embodiment, the core metal 2*a* is 28 mm in outer diameter and 3 mm in thickness. In this embodiment, the heat-resistant elastic layer 2*b* is 5 mm in thickness, and the electroconductive surface layer 2*c* is 50 μm in thickness.

Even in the case where the recording material P, having a maximum width, usable in the image forming apparatus 100 is used, in a region on the surface of the pressing roller 2 in non-contact with the recording material P, a discharging brush (discharging needle) 27 as a discharging means (electroconductive brush) is contacted to the surface of the pressing roller 2 to maintain electrical conduction. Such a non-sheet-passing portion is generated in each of end sides of the pressing roller 2 with respect to the rotational axis direction of the pressing roller 2, but in this embodiment, the discharging brush 27 is contacted to the pressing roller 2 at the front-side non-sheet-passing portion. Further, the discharging brush 27 is electrically grounded (connected to the ground) via a diode 28 which is a rectifying element as a rectifying means.

The diode 28 is connected to the discharging brush 27 in a cathode side and is connected to the ground in an anode side. This is because, in this embodiment, the normal charge polarity of the toner is the negative polarity and the toner charge polarity of the unfixed toner image on the recording material P at the fixing nip N is principally the negative polarity, and therefore the surface potential of the pressing roller 2 is made to have the positive polarity opposite to the toner charge polarity.

The pressing roller 2 is, at its end portions with respect to the rotational axis direction of the core metal 2*a*, rotatably supported by side plates 21 and 22 via bearings 26 and 26 in the front and rear sides of the fixing device 10.

The fixing roller 1 and the pressing roller 2 are press-contacted to each other against an elastic force of the heat-resistant elastic layer 2*b* of the pressing roller 2 by an urging mechanism (not shown). As a result, between the fixing roller 1 and the pressing roller 2, the fixing nip N, of about 5 mm in width with respect to the conveyance direction of the recording material P, for nipping and conveying the recording material P to fix the toner image on the recording material P is formed.

Here, it is important that the core metal 1*a* of the fixing roller 1 and the surface layer 2*c* of the pressing roller 2 are electrically insulated. That is, as described above, in order to make the surface potential of the pressing roller 2 to have the positive polarity opposite to the toner charge polarity (the negative polarity in this embodiment), to the surface of the pressing roller 2, the cathode of the diode 28 is connected. However, in the case where the surface layer 2*c* of the pressing roller 2 and the core metal 1*a* of the fixing roller 1 are electrically conducted to each other, the positive electric charges of the pressing roller 2 are moved to the core metal 1*a* of the fixing roller 1, so that it becomes difficult to stably make the surface potential of the pressing roller 2 to have the positive polarity.

Accordingly, as shown in FIG. 4, in this embodiment, as the surface layer 1*b* of the fixing roller 1, the electrically insulating fluorine-containing resin layer of $10^{16}$ Ω·cm or more in volume resistivity is used. That is, in this embodiment, the surface layer 1*b* of the fixing roller 1 is formed as the electrically insulating layer which is a layer formed of an electrically insulating material. Further, in this embodiment, a length of the surface layer 1*b* of the fixing roller 1 with respect to the rotational axis direction is made longer than a length of the electroconductive surface layer 2*c* of the pressing roller 2. As a result, even when the fixing roller 1 and the pressing roller 2 are rotated, the core metal 1*a* of the fixing roller 1 and the electroconductive surface layer 2*c* of the pressing roller 2 can always maintain electrical insulation therebetween.

Incidentally, when the volume resistivity of the electroconductive surface layer 2*c* of the pressing roller 2 is excessively small, mechanical strength and toner parting property of the electroconductive surface layer 2*c* are lowered. Further, when the volume resistivity of the electroconductive surface layer 2*c* of the pressing roller 2 is excessively large, an electroconductive effect cannot be expected. From these results, the volume resistivity of the electroconductive surface layer 2*c* of the pressing roller 2 may desirably be $10^3$ Ω·cm to $10^{13}$ Ω·cm.

The coil assembly 3 as the magnetic field generating means is an assembly of a bobbin 4, a core material (magnetic core) 5 (5*a*, 5*b*) formed of a magnetic material, an exciting coil (induction coil) 6, a stay 7 prepared by an electrically insulating member, and the like. The magnetic core 5 is held by the bobbin 4. Further, the exciting coil 6 is formed by winding an electric wire around the bobbin 4. A unit consisting of the bobbin 4, the magnetic core 5 and the exciting coil 6 is fixed and supported by the stay 7.

The coil assembly 3 is, at the hollow portion inside the fixing roller 1, non-rotationally fixed and disposed in a state in which the coil assembly 3 takes a predetermined angular attitude and in which a certain gap (spacing) is held between the inner surface of the fixing roller 1 and the exciting coil 6. The coil assembly 3 is supported, at longitudinal end portions 7*a* and 7*b* of the stay 7, by holding members 24 and 25 in the front and rear sides, respectively, of the fixing device 10.

The magnetic core 5 is formed of a material, such as ferrite or permalloy, having high permeability and low residual magnetic flux density. Further, the magnetic core 5 guides magnetic flux generated by the exciting coil 6 to the fixing roller 1. In this embodiment, the magnetic core 5 has a T-shape in cross section substantially perpendicular to the rotational axis direction of the fixing roller 1. This T-shaped magnetic core 5 is controlled by two plate-like magnetic cores in combination consisting of a base portion (lateral bar portion) 5*a* and a projected portion (perpendicular bar portion) 5*b*.

The exciting coil 6 has a shape such that a wound wire portion wound in a substantially elliptical shape so as to extend in substantially parallel to the rotational axis direction of the fixing roller 1 is curved along the inner surface of the fixing roller 1. Further, the exciting coil 6 is a bundle of Litz wire which is wound plural times along the shape of the bobbin 4 in an elongated boat shape so as to go around the magnetic core 5 and which is folded at longitudinal ends of the bobbin 4, and is curved and disposed so as to extend along the inner peripheral surface of the fixing roller 1. The projected portion 5*b* of the magnetic core 5 is provided so as to penetrate through the bobbin 4 from the base portion 5*a* of the magnetic core 5 toward a winding center of the exciting coil 6.

Two lead wires (coil supply wires) 16*a* and 16*b* of the exciting coil 6 are led from the rear side to the outside of the stay 7. These lead wires 16*a* and 16*b* are connected to a high-frequency inverter (exciting circuit) 60 for supplying a high-frequency current to the exciting coil 6.

The recording material P conveyed from an image forming portion (transfer portion) side to the fixing device 10 is guided to an entrance portion of the fixing nip N by a front fixing guide plate 12. Further, the recording material P coming out of the fixing nip N after being guided into the fixing nip N is suppressed by a separation claw 13 from being wound around the fixing roller 1, thus being separated from the fixing roller 1. The recording material P coming out of an exit portion of the fixing nip N is guided to the outside of the fixing device 10 by a rear fixing guide plate 14, thus being discharged.

The bobbin 4, the stay 7 and the separation claw 13 are formed of heat-resistant and electrically insulating engineering plastics.

At a rear-side end portion of the fixing roller 1, a drive gear G1 as a drive transmission member is provided. To this drive gear G1, a rotational force is transmitted from a driving source M1 via a drive transmission system (not shown). As a result, the fixing roller 1 is rotationally driven in an arrow A direction (clockwise direction) in FIG. 2 at a peripheral speed of 300 mm/sec.

Further, on the fixing device 10, a fixing roller cleaner 15 is provided. The fixing roller cleaner 15 includes a cleaning web 15*a* as a cleaning member, a web feeding shaft portion 15*b* by which the cleaning web is rolled and held, and a web winding-up shaft portion 15*c*. Further, the fixing roller cleaner 15 includes an urging roller 15*d* for urging the web 15*a*, between the web feeding shaft portion 15*b* and the web winding-up shaft portion 15*c*, against an outer surface of the fixing roller 1. A deposited matter such as the toner offset onto the surface of the fixing roller 1 is wiped with the web 15*a* urged against the fixing roller 1 by the urging roller 15*d*, so that the outer surface of the fixing roller 1 is cleaned. The web 15*a* urged against the fixing roller 1 is gradually renewed by being fed little by little from the feeding shaft portion 15*b* side to the winding-up shaft portion 15*c* side.

On the fixing device 10, a thermistor 11 which is a temperature sensor as a temperature detecting means for detecting a temperature of the fixing roller 1 is provided. In this embodiment, the thermistor 11 functions as a central portion temperature detecting device for the fixing roller 1. That is, the thermistor 11 is, in the neighborhood of a central portion (a phantom line S in FIG. 3) of the fixing roller 1 with respect to the rotational axis direction of the fixing roller 1, disposed in contact with the surface of the fixing roller 1 so as to oppose the exciting coil 6 via the fixing roller 1. The thermistor 11 is urged against the outer surface of the fixing roller 1 by an elastic member, thus being elastically press-contacted to the fixing roller 1. A temperature detection signal of the thermistor 11 is inputted into a controller (CPU) 50 which is a control circuit as a control means provided in the image forming apparatus 100.

Next, an operation of the fixing device 10 will be described.

The controller 50 of the image forming apparatus 100 turns on a main power switch of the image forming apparatus 100 to actuate the image forming apparatus 100, thus starting predetermined image forming sequence control. In the fixing device 10, the driving source M1 is actuated, so that rotation of the fixing roller 1 is started. By this rotation of the fixing roller 1, also rotation of the pressing roller 2 is started. Further, the controller 50 actuates a high-frequency inverter (exciting circuit) 60 as a current applying device, so that a high-frequency current (e.g., 10 kHz to 100 kHz in fixing roller) is applied to the exciting coil 6. As a result, a high-frequency AC magnetic flux is generated around the exciting coil 6, so that the core metal of the fixing roller 1 generates heat by electromagnetic induction heat generation and thus the fixing roller 1 is gradually increased in temperature toward a predetermined fixing temperature (e.g., 170° C.). This temperature rise is detected by the thermistor 11, and then detected temperature information is inputted into the controller 50. The controller 50 effects temperature control of the fixing roller 1 so that the temperature detected by the thermistor 11 is maintained at the predetermined fixing temperature by controlling electric power to be supplied from the high-frequency inverter 60 to the exciting coil 6.

In this temperature control state, into the fixing nip N, the recording material P as a material-to-be-heated on which the unfixed toner image t is carried is guided from the image forming portion side. Then, the recording material P is nipped and conveyed through the fixing nip N, so that the unfixed toner image t is fixed on the surface of the recording material P under application of heat of the fixing roller 1 and pressure at the fixing nip N.

3. Electromagnetic Induction Heat Generation

Next, with reference to FIG. 5, a principle of the electromagnetic induction heat generation of the core metal 1*a* of the fixing roller 1 will be described.

Figure 5:
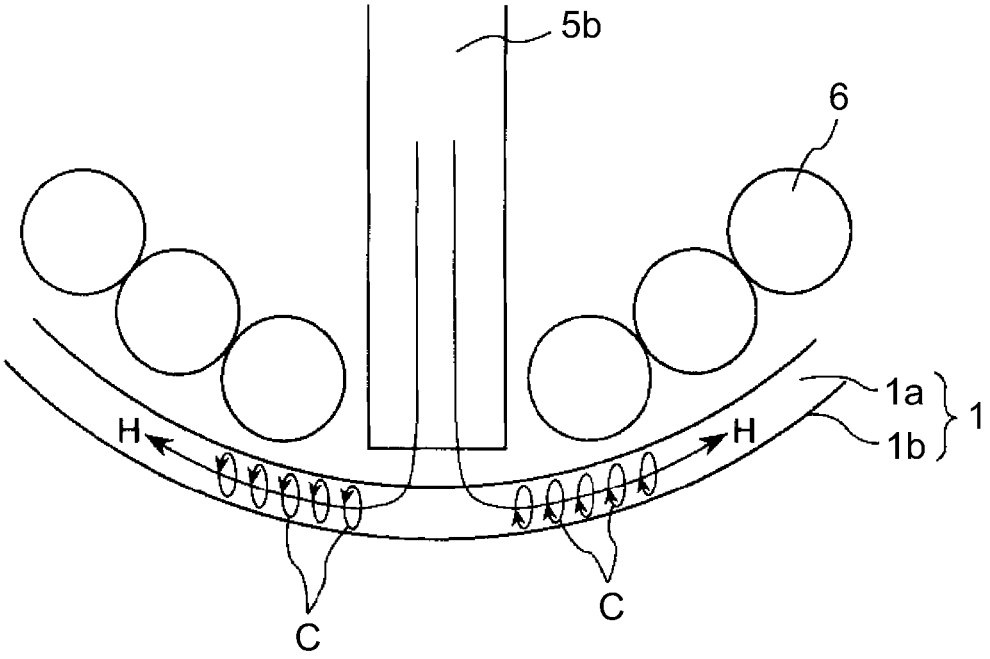
FIG. 5 is a schematic view for illustrating a heat generation principle of a fixing roller in Embodiment 1.

To the exciting coil 6, an AC current is applied from the high-frequency inverter 60, so that generation and extinction of magnetic flux indicated by an arrow H in FIG. 5 are repeated at a periphery of the exciting coil 6. The magnetic flux H is guided along a magnetic path formed by the magnetic core 5 (5*a*, 5*b*) and the core metal 1*a*. Depending on a change in magnetic flux generated by the exciting coil 6, in the core metal 1*a*, eddy current is generated so as to generate magnetic lux in a direction in which the change in magnetic flux is prevented. The eddy current is indicated by an arrow C in FIG. 5. This eddy current C concentratedly flows on the surface of the core metal 1*a* in the exciting coil 6 side by the skin effect, so that heat is generated with electric power which is proportional to skin resistance Rs of the core metal 1*a*.

Here, a skin depth δ (m) and the skin resistance Rs (Ω) which are obtained from a frequency f (Hz) of the AC current applied to the exciting coil 6, (magnetic) permeability μ (H/m) of the core metal 1*a*, and a specific resistance ρ are represented by the following formulas 1 and 2.

$$\delta = \sqrt{\frac{\rho}{\pi\mu f}} \quad \text{(formula 1)}$$

$$Rs = \frac{\rho}{\delta} = \sqrt{\pi\mu f\rho} \quad \text{(formula 2)}$$

Further, eddy current $I_f$(A) inducted into the core metal 1*a* is proportional to an amount of magnetic flux passing through (the inside of) the core metal 1*a*, and therefore is represented by, using the number of winding N (times) of the exciting coil 6 and a coil current I (A) applied to the exciting coil 6, the following formula 3.

$$I_f \propto NI \quad \text{(formula 3)}$$

From the above formulas, electric power W (W) generated in the core metal 1*a* is Joule heat generation based on the skin resistance Rs and the eddy current $I_f$ induced into the core metal 1*a*, and therefore is represented by the following formula 4.

$$W = Rs \cdot I_f^2 \propto \sqrt{\mu f \rho}(NI)^2 \quad \text{(formula 4)}$$

From the formula 4, in order to increase an amount of heat generation of the core metal 1*a*, it is understood that a material, including ferromagnetic metal such as iron or nickel or alloy of these metals, which has high permeability (large μ) and high resistance (large ρ) may only be required to be used or that the number of winding of the exciting coil 6 may also be increased.

Further, by controlling the coil current I applied from the high-frequency inverter 60 to the exciting coil 6 or controlling the frequency f of the coil current I, it becomes possible to optimally control the amount of heat generation of the core metal 1*a*.

4. Suppression of Electrostatic Offset

Figure 6:
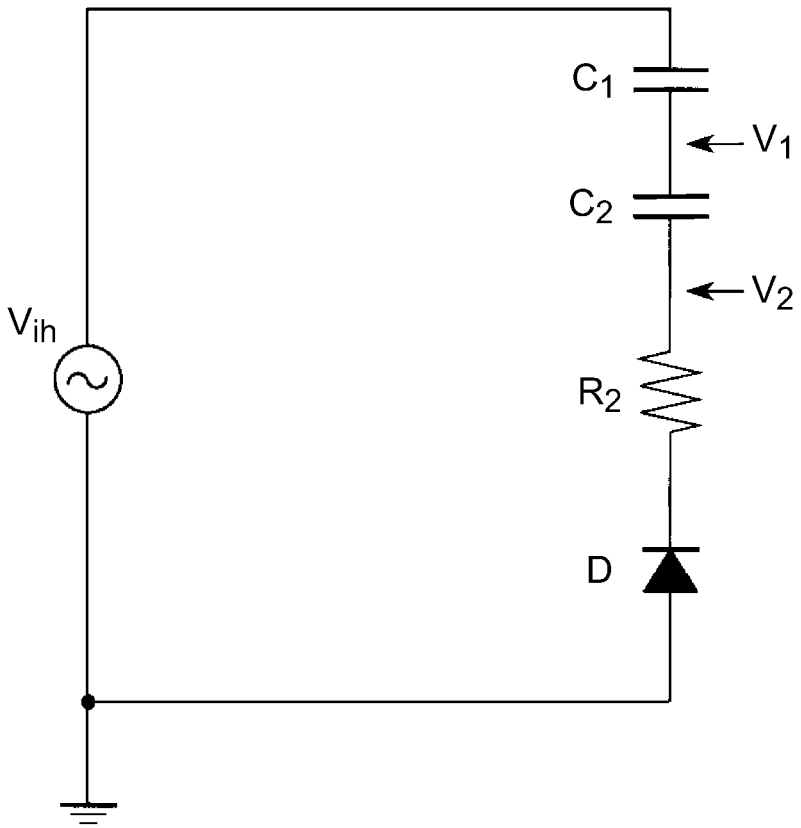
FIG. 6 is an equivalent circuit diagram of the fixing device in Embodiment 1.

FIG. 6 shows an equivalent circuit of the fixing device 10 in this embodiment.

Vih represents a voltage based on the high-frequency current by the exciting coil 6. Vih in this embodiment is about 50 V to about 600 V, and the frequency of the high-frequency current is about 10 kHz to about 100 kHz.

$C_1$ represents a capacitor between the exciting coil 6 and the core metal 1*a* of the fixing roller 1. A capacitance value of $C_1$ depends on ambient dielectric constant between the core metal 1*a* and each of the exciting coil 6, the stay 7, and the bobbin 4 for holding the exciting coil 6.

$C_2$ represents a capacitor between the core metal 1*a* of the fixing roller 1 and the electroconductive surface layer 2*c* of the pressing roller 2. A capacitance value of $C_2$ depends on dielectric constant of the surface layer 1*b* of the fixing roller 1.

$R_2$ represents a resistor between the electroconductive surface layer 2*c* of the pressing roller 2 and the diode 28. A resistance value of $R_2$ depends on a volume resistance of the electroconductive surface layer 2*c* of the pressing roller 2 and a contact resistance between the discharging brush 27 and the electroconductive surface layer of the pressing roller 2.

D represents the diode 28, which is connected to the discharging brush 27 in the cathode side and which is electrically connected to the ground in the anode side.

The surface potential of the fixing roller 1 is shown by a potential in a position of $V_1$ in FIG. 6. Further, the surface potential of the pressing roller 2 is shown by a potential in a position of $V_2$ in FIG. 6. As described above, the core metal 1*a* of the fixing roller 1 and the electroconductive surface layer 2*c* of the pressing roller 2 are electrically insulated from each other, and therefore the potential $V_1$ of the fixing roller 1 and the potential $V_2$ of the pressing roller 2 provide a predetermined potential difference.

Next, with reference to FIG. 7, waveforms of the surface potential $V_1$ of the fixing roller 1 ((a) of FIG. 7) and the surface potential $V_2$ of the pressing roller 2 ((b) of FIG. 7) will be described.

In (a) of FIG. 7, the surface potential $V_1$ of the fixing roller 1 is a potential induced by the high-frequency current based on the voltage Vih, and therefore is equal in frequency to the voltage Vih, so that an average (Ave) thereof is substantially 0 V.

On the other hand, in (b) of FIG. 7, the surface potential $V_2$ of the pressing roller 2 is, since the electroconductive surface layer 2*c* is connected to the cathode side of the diode 28 via the resistor $R_2$, half-wave rectified into only the positive polarity, so that an average (Ave) thereof has the positive polarity.

Thus, in this embodiment, the high-frequency potential is induced into the core metal 1*a* of the fixing roller 1, and therefore it is possible to make the average of the surface potential $V_1$ of the fixing roller 1 to be substantially 0 V and also possible to make the average of the surface potential $V_2$ of the pressing roller 2 to have the positive polarity. That is, the toner, of the unfixed toner image on the recording material P, which is principally charged to the negative polarity is electrostatically held strongly on the recording material P at the fixing nip N since the surface potential of the pressing roller 2 contacting the back surface (opposite from the toner-carrying surface) of the recording material P has the positive polarity opposite to the negative polarity. On the other hand, at the fixing nip N, the surface potential of the fixing roller 1 contacting the toner on the recording material P is 0 V as an average, and therefore a force for electrostatically attracting the toner on the recording material P is relatively weak. For that reason, with a simple constitution, it becomes possible to suppress the electrostatic offset onto the fixing roller 1.

Here, as a comparison example, the case where a halogen heater was used as a heating source as described in JP-A Hei 3-145682 was studied. In this case, the surface potential $V_1$ of the fixing roller 1 and the surface potential $V_2$ of the pressing roller 2 are continuously increased (charge-up), with continuous sheet passing, by triboelectric charge between the recording material P and each roller and by triboelectric charge between the respective rollers. For that reason, after the continuous sheet passing of about 1000 sheets, an occurrence of the electrostatic offset was suppressed, but leakage to peripheral members was generated, and toner scattering, onto an output image, due to each of the potentials was able to be confirmed.

On the other hand, in this embodiment, the core metal 1*a* of the fixing roller 1 is induction-heated, and the electroconductive surface layer 2*c* is provided as the surface layer of the pressing roller 2 electrically insulated from the core metal 1*a* of the fixing roller 1. Then, to the electroconductive surface layer 2*c*, the cathode side of the diode 28 is connected, and the anode side of the diode 28 is grounded. For that reason, by the high-frequency potential induced into the core metal la of the fixing roller 1, the surface potential $V_1$ of the fixing roller 1 and the surface potential $V_2$ of the pressing roller 2 are determined, so that the charge-up by the triboelectric charge as described above is suppressed. Further, in this embodiment, also after the continuous sheet passing, not only the occurrence of the electrostatic offset was suppressed but also both of the leakage to the peripheral members and the toner scattering were not generated.

Here, in the constitution in this embodiment, in order to maintain the potentials of the fixing roller 1 and the pressing roller 2 as described above, eddy current may preferably be induced into the core metal 1*a* of the fixing roller 1. For this reason, at least during passing of the recording material P, on which the unfixed toner image is carried, through the fixing nip N, a state in which the high-frequency current is applied to the exciting coil 6 may preferably be maintained. Ordinarily, during the passing of the recording material P, on which the unfixed toner image is carried, through the fixing nip N, a state in which heat is taken from the fixing roller 1 by the recording material P is created, and therefore the state in which the high-frequency current is applied to the exciting coil 6 is maintained.

Incidentally, with respect to respective constitutions and set values of the fixing device 10, each of those is merely an example and can be appropriately changed depending on an operating condition. Particularly, when a constitution capable of maintain electrical insulation between the electroconductive heat generating layer of the fixing roller 1 and the electroconductive layer of the pressing roller 2 is employed, a layer structure of the fixing roller 1 and the pressing roller 2 is not limited to that in this embodiment, but it is possible to obtain a similar effect also in the following modified embodiments. Parts (a) to (d) of FIG. 8 are schematic enlarged sectional views each for illustrating the layer structure of the fixing roller 1 and the pressing roller 2 in this embodiment or the modified embodiment, in which (a) shows the layer structure in this embodiment, and (b) to (d) show the layer structures in the modified embodiments.

For example, as shown in (b) of FIG. 8, the surface layer of the pressing roller 2 is formed as an insulating surface layer 2*c* by using electrically insulating fluorine-containing resin, and the elastic layer under the surface layer is formed as an electroconductive elastic layer 2*b* by using an electroconductive rubber. Further, the electroconductive elastic layer 2*b* and the diode 28 may be connected, or the core metal 1*a* and the diode 28 may also be connected.

Further, as shown in (c) of FIG. 8, the surface layer of the pressing roller 2 is formed as an insulating surface layer 2*c*, and an electroconductive layer 2*d* is provided between the insulating surface layer 2*c* and an elastic layer 2*b*, and then the electroconductive layer 2*d* and the diode 28 may also be connected.

Further, as shown in (d) of FIG. 8, in the case where the surface layer of the fixing roller 1 is the electroconductive surface layer 1*b*, when an insulating layer 1*c* is provided between the electroconductive surface layer 1*b* and an electroconductive heat generating layer 1*a*, it is possible to ensure electrical insulating between the electroconductive heat generating layer 1*a* of the fixing roller 1 and the electroconductive surface layer 2*c* of the pressing roller 2. In this case, the layer structure of the pressing roller 2 may be any one of those shown in (a) to (c) of FIG. 8. The layer structure of the pressing roller 2 in (d) of FIG. 8 is the same as that of the pressing roller 2 in (a) of FIG. 8.

As described above, according to this embodiment, the electroconductive layer of the rotatable pressing member is provided as the surface layer contacting the recording material or as a layer under the surface layer. Further, between the electroconductive layer and the ground, the diode is connected in a direction in which the surface of the rotatable pressing member has the opposite polarity to the charge polarity of the toner. Further, the electroconductive heat generating layer of the rotatable heating member and the electroconductive layer of the rotatable pressing member are electrically insulated. For that reason, an electrostatic depositing force of the toner on the recording material is not impaired, and therefore it is possible to suppress the electrostatic offset.

Embodiment 2

Next, another embodiment of the present invention will be described. Basic constitutions and operations of an image forming apparatus and a fixing device in this embodiment are the same as those in Embodiment 1. Accordingly, elements having the same or corresponding functions are represented by the same reference numerals or symbols and will be omitted from detailed description.

In Embodiment 1, the core metal 1*a* of the fixing roller 1 is not electrically grounded. For that reason, in Embodiment 1, the surface potential $V_1$ of the fixing roller 1 has the high-frequency waveform as shown in (a) of FIG. 7. For this reason, the surface potential $V_1$ of the fixing roller 1 is substantially zero as an average, but at each instant when the fixing roller 1 is heated, the potential of the positive polarity or the negative polarity is held. Accordingly, at an instant when the surface potential $V_1$ of the fixing roller 1 has the positive polarity, it would be considered that the electrostatic offset is somewhat generated.

FIG. 9 is a schematic front view of a principal part of the fixing device 10 in this embodiment.

In this embodiment, to the surface of the core metal 1*a* as the electroconductive heat generating layer of the fixing roller 1, a discharging brush (discharging needle) 29 as a discharging means (electroconductive brush) is contacted, so that electrical conduction is maintained. Further, this discharging brush 29 is electrically grounded (connected to the ground). Incidentally, in this embodiment, the discharging brush 29 is contacted to the surface (non-sheet-passing portion), of the fixing roller 1, located outside the front-side side plate. At the portion where the discharging brush 29 is grounded with respect to the rotational axis direction of the fixing roller 1, the insulating surface layer 1*b* is not provided. However, the discharging brush 29 may also be contacted to, e.g., an inner surface of the fixing roller 1.

FIG. 10 shows an equivalent circuit of the fixing device 10 in this embodiment.

$C_1$, $C_2$, $R_2$ and D are as described above in Embodiment 1.

$R_1$ represents a contact resistance between the discharging brush 29 and the core metal 1*a* of the fixing roller 1.

Further, in this embodiment, (potential) waveforms of the surface potential $V_1$ of the fixing roller 1 and the surface potential $V_2$ of the pressing roller 2 are as shown in (a) and (b) of FIG. 11, respectively.

That is, the core metal 1*a* of the fixing roller 1 is electrically grounded via the discharging brush 29, and therefore the surface potential of the fixing roller 1 is substantially zero.

Thus, in this embodiment, the surface potential $V_1$ of the fixing roller 1 is always substantially zero, and an average of the surface potential $V_2$ of the pressing roller 2 can be made to have the positive polarity. In this embodiment, the surface potential $V_2$ of the pressing roller 2 is not instantaneously made to have the positive polarity, and therefore it is also possible to suppress the electrostatic offset having a possibility that the electrostatic offset is somewhat generated by the photosensitive drum of the surface potential $V_2$ of the pressing roller 2. For that reason, with a simple constitution, it becomes possible to suppress the electrostatic offset more satisfactory.

As described above, according to this embodiment, the electroconductive heat generating layer of the rotatable heating member is electrically grounded, and therefore the surface potential of the rotatable heating member can be always made about zero. For that reason, the electrostatic offset can be suppressed further.

Incidentally, with respect to the respective constitutions and set values of the fixing device 10, those in this embodiment are merely an example, and similarly as described in Embodiment 1, can be appropriately changed (particularly with respect to the layer structure of the fixing roller 1 and the pressing roller 2 as shown in (a) to (d) of FIG. 8).

Embodiment 3

Next, another embodiment of the present invention will be described. Basic constitutions and operations of an image forming apparatus and a fixing device in this embodiment are the same as those in Embodiment 1. Accordingly, elements having the same or corresponding functions are represented by the same reference numerals or symbols and will be omitted from detailed description.

FIG. 12 is a schematic front view of a principal part of the fixing device 10 in this embodiment.

In this embodiment, to the surface of the core metal 1*a* as the electroconductive heat generating layer of the fixing roller 1, a discharging brush (discharging needle) 29 as a discharging means (electroconductive brush) is contacted, so that electrical conduction is maintained. Further, this discharging brush 29 is electrically grounded (connected to the ground) via a diode 30 which is a rectifying element as a rectifying means. Incidentally, in this embodiment, the discharging brush 29 is contacted to the surface (non-sheet-passing portion), of the fixing roller 1, located outside the front-side side plate. At the portion where the discharging brush 29 is grounded with respect to the rotational axis direction of the fixing roller 1, the insulating surface layer 1*b* is not provided. However, the discharging brush 29 may also be contacted to, e.g., an inner surface of the fixing roller 1.

In this embodiment, the diode 30 is connected to the discharging brush 29 in the anode side and is grounded in the cathode side. This is because the surface potential of the fixing roller 1 is made to have the negative polarity identical to the charge polarity of the toner since the normal charge polarity of the toner is principally the negative polarity and the charge polarity of the toner of the unfixed toner image on the recording material P at the fixing nip N is principally the negative polarity.

FIG. 13 shows an equivalent circuit of the fixing device 10 in this embodiment.

$C_1$, $C_2$ and $R_2$ are as described above in Embodiment 1.

$R_1$ represents a contact resistance between the discharging brush 29 and the core metal 1*a* of the fixing roller 1.

$D_1$ is the diode 30 connected to the core metal la of the fixing roller 1 via the discharging brush 29, and is connected with the discharging brush 29 in the anode side and is electrically grounded in the cathode side.

$D_2$ is the diode 28 connected to the electroconductive surface layer 2*c* of the pressing roller 2 via the discharging brush 27, and is connected with the discharging brush 27 in the cathode side and is electrically grounded in the anode side.

Further, in this embodiment, waveforms of the surface potential $V_1$ of the fixing roller 1 and the surface potential $V_2$ of the pressing roller 2 are as shown in (a) and (b) of FIG. 14, respectively.

That is, in this embodiment, the electromagnetic induction heating type is employed, and therefore the surface potential $V_1$ of the fixing roller 1 is the potential induced by the high-frequency current of Vih and thus has the same frequency as that of Vih. Further, the surface potential $V_1$ of the fixing roller 1 is connected to the anode side of the diode 30 via the resistor $R_1$, and therefore half-wave rectified with respect to only the negative polarity, so that an average thereof has the negative polarity ((a) of FIG. 14).

On the other hand, the surface potential $V_2$ of the pressing roller 2 is connected to the cathode side of the diode 28 via the resistor $R_2$, and therefore half-wave rectified with respect to only the positive polarity, so that an average thereof has the positive polarity ((b) of FIG. 14).

Thus, in this embodiment, the surface potential $V_1$ of the fixing roller 1 always has the negative polarity, and the surface potential $V_2$ of the pressing roller 2 can be made to always have the positive polarity.

Accordingly, a potential difference between the surface potential $V_1$ of the fixing roller 1 and the surface potential $V_2$ of the pressing roller 2 can be made larger. That is, on the toner of the unfixed toner image on the recording material P at the fixing nip N, a force in a repelling direction is exerted from the fixing roller 1 side and a force in an attracting direction is exerted from the pressing roller 2 side (i.e., the recording material P side). For that reason, it is possible to suppress the electrostatic offset more satisfactory.

As described above, according to this embodiment, between the electroconductive heat generating layer of the rotatable heating member and the ground, the diode is connected with respect to a direction such that the surface of the rotatable heating member has the same polarity as the toner charge polarity. For that reason, the electrostatic offset can be suppressed further.

Incidentally, with respect to the respective constitutions and set values of the fixing device 10, those in this embodiment are merely an example, and similarly as described in Embodiment 1, can be appropriately changed (particularly with respect to the layer structure of the fixing roller 1 and the pressing roller 2 as shown in (a) to (d) of FIG. 8).

Other Embodiments

As described above, the present invention has been described based on the specific embodiments, but is not limited to the above-described embodiments.

(1) The image heating apparatus is not limited to the use as the fixing devices in the above-described embodiments. For example, the image heating apparatus is also effective as image heating apparatuses such as a temperature fixing device for temporarily fixing an unfixed image on a recording material, and a surface-modifying device for modifying an image surface property such as glossiness by re-heating the recording material on which a fixed image is carried.

(2) The shape of the rotatable heating member is not limited to the roller. For example, the rotatable heating member can also have another shape such as an endless belt. Further, also with respect to the rotatable pressing member, similarly, the shape is not limited to the roller. For example, the rotatable pressing member can also have another shape such as the endless belt.

(3) The electromagnetic induction heating of the electroconductive heat generating layer (core metal) by the magnetic flux generating means is not limited to the internal heating type as the above-described embodiments. It is also possible to employ a device constitution of an external heating type in which the magnetic flux generating means is provided outside the fixing roller.

(4) The winding shape of the exciting coil is not limited to the shape such that the electric wire extended and wound in parallel to the longitudinal direction of the rotatable heating member. For example, the exciting coil may also be wound in a direction in which the exciting coil is substantially coaxial with the rotatable heating member.

(5) The normal charge polarity of the toner is not limited to the negative polarity in the embodiments described above, but may also be the positive polarity. In that case, the diode may only be required to be connected in the opposite direction to that in the embodiments described above.

(6) In the above-described embodiments, the fixing roller cleaner is provided, but it is also possible to employ a constitution in which the fixing roller cleaner is omitted.

While the invention has been described with reference to the structures disclosed herein, it is not confined to the details set forth and this application is intended to cover such modifications or changes as may come within the purpose of the improvements or the scope of the following claims.

What is claimed is:

1. An image heating apparatus comprising:

an exciting coil;

a current applying device configured to apply a high-frequency current to said exciting coil;

a rotatable heating member configured to heat a toner image on a recording material at a nip, said rotatable heating member including an electroconductive base layer for generating heat by electromagnetic induction of magnetic flux from said exciting coil and an insulating surface layer provided on the electroconductive base layer;

a rotatable pressing member configured to press-contact said rotatable heating member to form the nip, said rotatable pressing member including an electroconductive surface layer having (i) a volume resistivity of $10^3$ to $10^{13}$ Ω·cm and (ii) a width so as to be electrically insulated from the electroconductive base layer by the insulating surface layer; and a rectifying element configured to be connected between the electroconductive surface layer and the ground in a direction in which a surface potential of said rotatable pressing member has an opposite polarity to a normal charge polarity of a toner.

2. An image heating apparatus according to claim 1, further comprising an electroconductive brush configured to contact the electroconductive surface layer, wherein said rectifying element is connected between said electroconductive brush and the ground.

3. An image heating apparatus according to claim 1, wherein said rectifying element is a diode.

4. An image heating apparatus according to claim 1, further comprising another rectifying element configured to be connected between the electroconductive base layer and the ground in a direction in which the surface potential of said rotatable pressing member has an identical polarity to the normal charge polarity of the toner.

5. An image heating apparatus according to claim 4, further comprising another electroconductive brush configured to contact the electroconductive base layer, wherein said another rectifying element is connected between said another electroconductive brush and the ground.

6. An image heating apparatus according to claim 4, wherein said another rectifying element is a diode.

7. An image heating apparatus according to claim 1, wherein said rectifying element is a diode.

8. An image heating apparatus according to claim 7, further comprising an electroconductive brush configured to contact the electroconductive surface layer, wherein said rectifying element is connected between said electroconductive brush and the ground.

9. An image heating apparatus according to claim 8, further comprising another rectifying element configured to be connected between the electroconductive base layer and the ground in a direction in which the surface potential of said rotatable heating member has an identical polarity to the normal charge polarity of the toner.

10. An image heating apparatus according to claim 9, further comprising another electroconductive brush configured to contact the electroconductive base layer, wherein said another rectifying element is connected between said another electroconductive brush and the ground.

11. An image heating apparatus according to claim 9, wherein said another rectifying element is a diode.

12. An image heating apparatus according to claim 1, wherein the insulating surface layer has a volume resistivity of $10^{16}$ Ω·cm or more.

13. An image heating apparatus according to claim 1, wherein said current applying device applies a current of 10 kHz to 100 kHz in frequency.

14. An image heating apparatus comprising:

an exciting coil;

a current applying device configured to apply a high-frequency current of 10 kHz to 100 kHz in frequency to said exciting coil;

a heating roller configured to heat a toner image on a recording material at a nip, said heating roller including (i) a metal core for generating heat by electromagnetic induction of magnetic flux from said exciting coil and (ii) an insulating surface layer provided on the metal core and having a volume resistivity of $10^{16}$ Ω·cm or more;

a pressing roller configured to press-contact said heating roller to form the nip, said pressing roller including an electroconductive surface layer having (i) a width so as to be electrically insulated from the metal core by the insulating surface layer and (ii) a volume resistivity of $10^3$ to $10^{13}$ Ω·cm;

a diode configured to be connected between the metal core and the ground in a direction in which a surface potential of said heating roller has an identical polarity to a normal charge polarity of a toner; and another diode configured to be connected between the electroconductive surface layer and the ground in a direction in which a surface potential of said pressing roller has an opposite polarity to the normal charge polarity of the toner.

* * * * *